US005383791A

United States Patent [19]

Hirakui et al.

[11] Patent Number: 5,383,791

[45] Date of Patent: Jan. 24, 1995

[54] CONNECTOR FOR USE IN AN ELECTRIC ENDOSCOPE

[75] Inventors: Katsuya Hirakui; Masayuki Oyatsu, both of Tochigiken, Japan

[73] Assignee: Kabushiki Kaisha Toshiba, Kawasaki, Japan

[21] Appl. No.: 43,784

[22] Filed: Apr. 6, 1993

[30] Foreign Application Priority Data

Apr. 14, 1992 [JP] Japan ..... 4-094409

[51] Int. Cl.[6] ..... H01R 13/62

[52] U.S. Cl. ..... 439/312; 439/135

[58] Field of Search ..... 439/135, 136, 312, 314, 439/320, 321; 128/3, 6

[56] References Cited

U.S. PATENT DOCUMENTS

| | | | |
|---|---|---|---|
| 4,464,000 | 8/1984 | Werth et al. | 439/312 |
| 4,468,078 | 8/1984 | Frear et al. | 439/314 |
| 4,494,810 | 1/1985 | Schildkraut | 439/312 |
| 4,539,586 | 9/1985 | Danna et al. | 358/98 |
| 4,902,238 | 2/1990 | Iacobucci | 439/312 X |
| 5,082,454 | 1/1992 | Tonkiss et al. | 439/312 X |

*Primary Examiner*—Khiem Nguyen

*Attorney, Agent, or Firm*—Foley & Lardner

[57] ABSTRACT

A connector comprises a housing having a plurality of terminals. The housing is provided with a first bearing portion made of rigid material and a second bearing portion made of an elastic material. The operating handle is rotatably supported by the first and second bearing portions. The operating handle comprises a cam mechanism which is operated by the rotation of the operating handle.

11 Claims, 7 Drawing Sheets

CONNECTOR FOR USE IN AN ELECTRIC ENDOSCOPE

BACKGROUND OF THE INVENTION

This invention relates to a connector for use in an electric endoscope, especially for connecting a main body with a scope part therebetween.

In a conventional endoscope-connector, a rotating handle (that is, a bayonet collar) is in the shape of a cylinder and has a cam. The bayonet collar is coaxially disposed through the bearing portions around an outer surface of a housing accommodating a plurality of connector terminals. When receiving the bayonet collar with the bearing portions, since the length along the axial direction of the bayonet collar is relatively longer, bearing portions are disposed on opposed ends of the bayonet collar, respectively, so that the opposed ends of the bayonet collar are received by the bearing portions. In this type of connector, in order to prevent looseness of connection between the connector and the main body and to improve the operation feeling, the bayonet collar is provided with an appropriate friction.

To supply the friction to the bayonet collar, a friction board which is made of wool puff, synthetic leather and the like is put into a space between the bayonet collar and the housing and between each bearing portion. Alternatively, a leaf spring which is made of metal or resin is added to supply a side pressure to the bayonet collar from an inside thereof.

However, the method of using the friction board is difficult to have a stable friction torque because of subtle different sizes of the friction board. The method of using the leaf spring has an extremely smaller friction coefficient at a contact point between the bayonet collar and the bearing portions in comparison with the method of using the friction board. Therefore, it is necessary for the method using the leaf spring to supply a larger load to the contact point to have a heavy friction torque. As a result, the leaf spring is subjected to a heavy abrasion of a resin of the contact point.

Conventionally, when washing or disinfecting the scope portion provided with this type of connector, a water proof cap is fitted to the end opening of the connector to avoid the wash water or disinfectant to inflow into the connector from the end opening thereof.

However, It is difficult to quickly mount or dismount the cap on or from the connector, because the water proof cap is screwed into the connector along a thread provided on a peripheral surface of the connector.

Therefore, in the case of the electric endoscope apparatus comprising the main body and the scope portion which are connected to each other by using this type of conventional connector, a need of an abrasion-proof would occur or a stable friction torque to the bayonet collar would not secured. Furthermore, because of the aforesaid problem, a great deal of time is lost when preparing for starting an examination or when washing and disinfecting. Especially, it is difficult to deal with the time loss when desired to quickly wash the scope portion in a short clinical time.

SUMMARY OF THE INVENTION

It is an object of the present invention to provide a connector which comprises a structural advantage of being capable of supplying a stable friction torque to the bayonet collar and of having no requirement of an abrasion-proof, and comprises an operational advantage of being capable of detaching the main body from the connector easily.

It is another object of the present invention to provide a connector which is capable of detaching the cap for use in washing and disinfecting the scope portion in a short time with an easy operation.

To accomplish the above mentioned objectives, the present invention provides a connector for use in connecting the main body with the scope portion comprising a housing and a plurality of terminals held in the housing. A first bearing portion is made of rigid material and attached to the housing. A second bearing portion is made of elastic material which is disposed apart from the first bearing portion on the housing. And, an operating handle is supported rotatably by the first bearing portion and the second bearing portion. The operating handle comprises a cam mechanism which is operated with the rotation of the operating handle. The second bearing portion is pressed and modified between the operating handle and the housing, and produces pressure when regaining the shape.

In the preferred embodiment, the cam mechanism comprises a groove formed in the inner surface of the operating handle in a inclined manner in an axial direction. A protrusion on the main body engages with the groove. The protrusion slides along the groove by rotating the operating handle to bring into close contact the housing with the main body.

In another preferred embodiment, the connector further comprises the water-proof cap having a protrusion which engages with the groove. The protrusion slides along the groove by rotating the operating handle to bring the water-proof cap into close contact with the housing.

According to the connector of the present invention, at least one part of the bearing portion which receives the bayonet collar may be made of elastic resin or rubber. Because the elastic modification of the bearing portion produces a pressure to supply a stable friction torque to the bayonet collar or the housing, it is possible to absorb slight variations of the size in comparison with the conventional friction board. Consequently, the friction torque becomes stable which is for supplying to the bayonet collar or housing, and a mounting or demounting operation of the scope portion to the main body becomes easy. At the same time, it is preferred for enabling to perform the electrical connecting or disconnecting. Furthermore, there is an appropriate friction coefficient between the elastic bearing and the bayonet collar, the ratio of depending on the load is smaller than that of the conventional method of using the leaf spring. Therefore, there is no need to consider the abrasion.

According to the preferred embodiment of the present invention, the cam mechanism in the bayonet collar adds compression forces to the coil spring making a packing to cut off and release. Therefore, by the operation of the rotating handle, it is possible to fit the packing to the end opening of the housing and to make inner space of the housing to be cut off from the outside. The cam process of the rotating operation is substantially shorter than that of the conventional screwing system. Consequently, it is possible to detach the water-proof cap from the connector with easier operation In shorter time compared with the conventional method.

DESCRIPTION OF THE PREFERRED EMBODIMENTS

Figure 1:
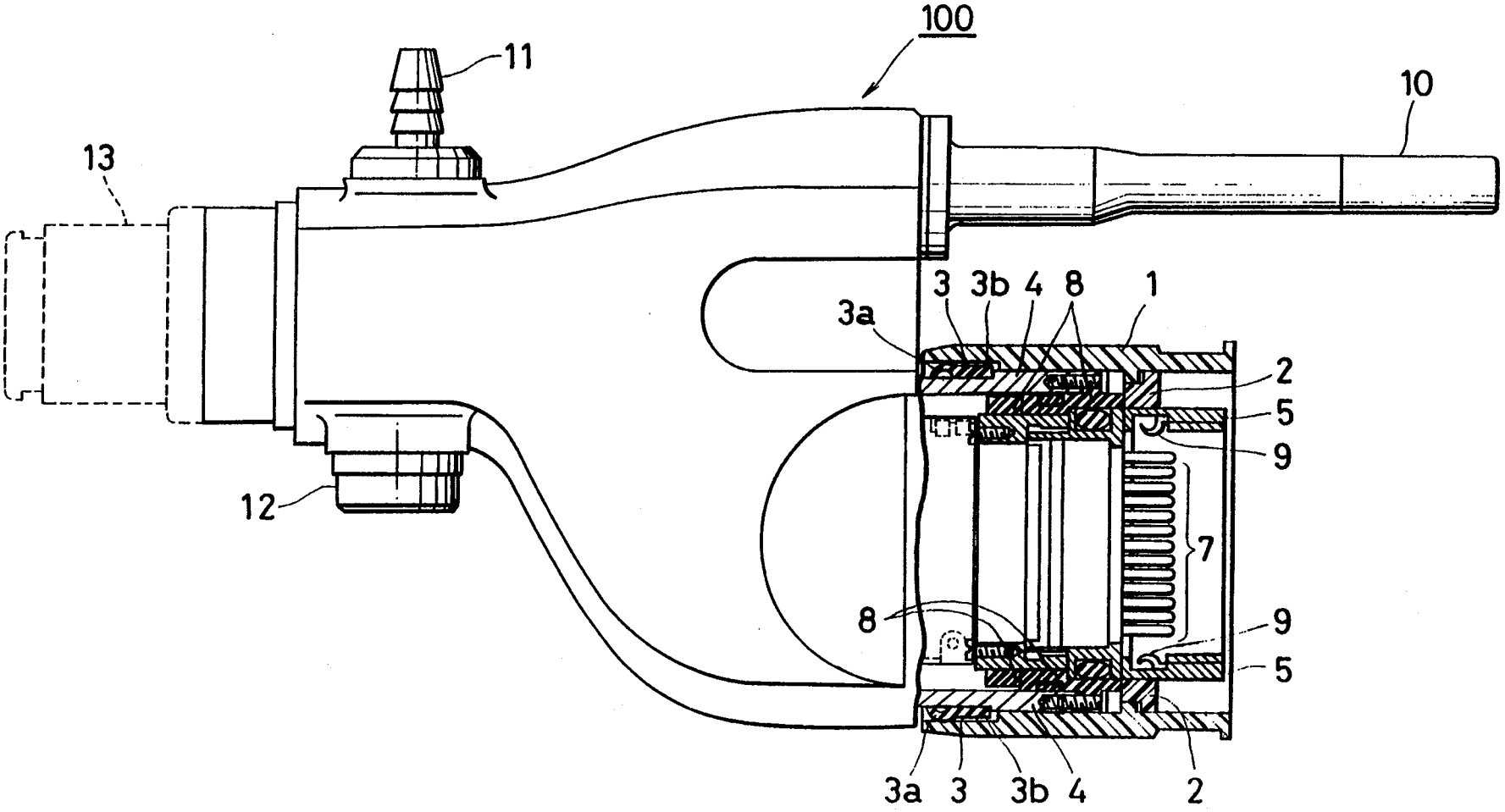
FIG. 1 is a schematic side view with a partial cutaway cross section of a connector for use in an electrical endoscope of an preferred embodiment of this invention.

FIG. 1 is a schematic side view with a partial cutaway cross section of a connector for use in an electrical endoscope of one preferred embodiment of this invention.

An endoscope connector 100 of this preferred embodiment comprises a rigid cylindrical bearing portion 2 for receiving one end of the bayonet collar 1 and an elastic cylindrical bearing portion 3 for receiving the other end. The bayonet collar 1 is disposed coaxially with the housing comprising a cylinder portion 4, a shell (shield case) 5, and insulating material 8. The rigid bearing portion 2 and the elastic bearing portion 3 are separated from each other and disposed on the housing. FIG. 1 also shows a plurality of connector terminals 7, contact springs 9, a light guide 10, a suction channel 11, an air and water supplying channel 12 and an universal cord 13 of the scope portion.

Figure 3:
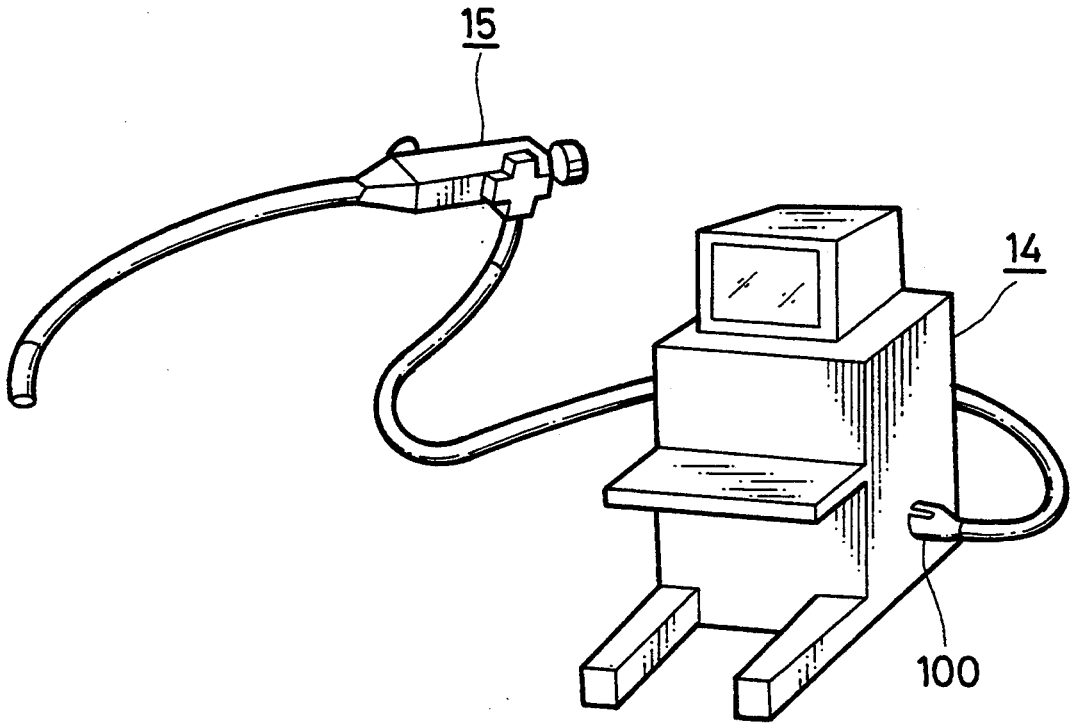
FIG.3 is a perspective view of the outline showing the scope portion connected with the main body by using the connector of FIG. 1.

As illustrated in FIG. 3, the rotating operation of the bayonet collar 1 enables connection or disconnection of the scope portion 15 from the main body 14 by the connector 100.

In the assembly mentioned above, the elastic bearing portion 3 may be made of resin or rubber, for instance, made of such resin as Rulon (Trade mark of NTN) producted by NTN Co.

Consequently the elastic bearing portion 3 is preferably made of fluororesin such as Teflon (polytetrafluoroethylene), and silicon rubber, more preferably, a rubber of polytetrafluoroethylene series.

The rigid bearing portion 2 is made of relatively rigid resin, preferably, fluororesin or silicone resin. The rigid bearing portion 2 comprises a cylindrical configuration which is fixed on the end of the insulation material 8.

Figure 2A:
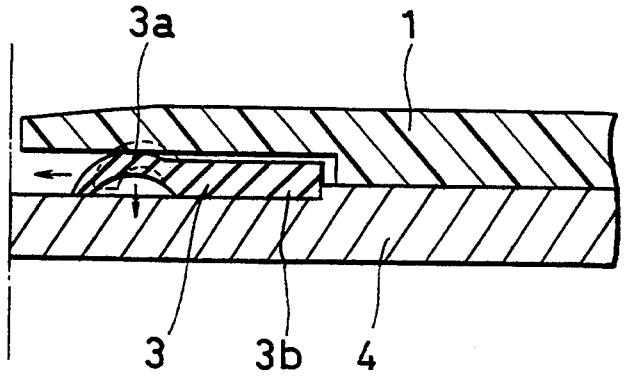
FIG. 2A an expanded sectional view of an elastic bearing portion provided for the connector of FIG. 1.
Figure 2B:
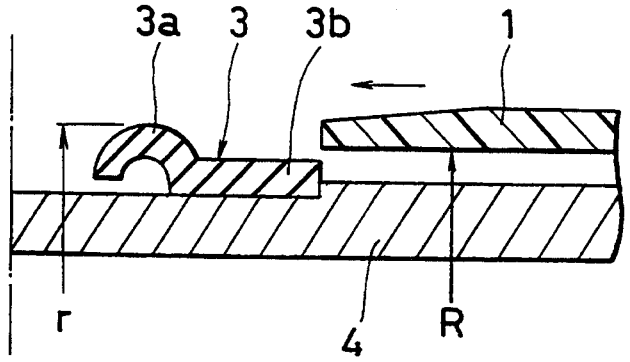
FIG. 2B is similar to FIG. 2A and is an expanded sectional view of the elastic bearing portion before mounting a bayonet collar on the elastic bearing portion.

Referring to FIGS. 2A and 2B, the elastic bearing portion 3 comprises a curved portion **3*a* and a straight line portion 3*b*. An inner peripheral surface of the straight line portion 3*b* is fixed on an outer surface of the cylinder portion 4**.

As shown in FIG. 2B, the curved portion **3*a* swells radially outwardly when the bayonet collar 1 is not mounted. In this condition, an outer radial (r) of the curved portion 3*a* is larger than an inner radial (R) of the bayonet collar 1 ($r>R$). The curved portion 3*a*** has a free end movable toward the radial and the axial directions.

The curved portion **3*a* is pressed radially toward the inner direction by the inner surface of the bayonet collar 1** when mounted.

As a result, as illustrated in FIG. 2A, the curved portion **3*a* is compressed radially toward the inner direction, and extends toward the axial direction with a modification. The curved portion 3*a* produces and supplies a predetermined pressure to an inner peripheral surface of the bayonet collar 1 with the modification thereof. The curved portion 3*a* supplies a predetermined pressure as a reversion force to the inner peripheral surface of the bayonet collar 1**.

Figure 2C:
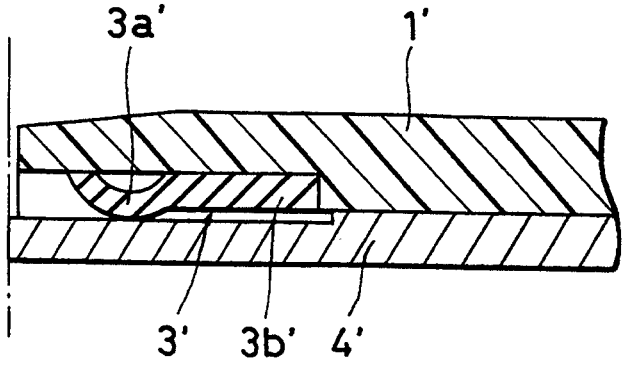
FIG. 2C is an expanded sectional view similar to FIG. 2A and shows a modified example of the elastic bearing portion.

FIG. 2C is an expanded sectional view, similar to FIG. 2A showing a modified example of the elastic bearing portion 3. In this embodiment of the modification, the outer peripheral surface of the straight line portion **3*b*' of the elastic bearing portion 3' is fixed on the inner peripheral surface of the bayonet collar 1'. The curved portion 3*a*' is compressed radially outwardly by the outer peripheral surface of the cylinder portion 4'. The curved portion 3*a*'** supplies the predetermined pressure produced by the restitutive force to the outer peripheral surface.

Although, the elastic bearing portion 3 comprises a single cylindrical rubber member which is fitted around the cylinder portion 4 in the preferred embodiment of this invention, the elastic bearing portion 3 may comprise a plurality of cylindrical rubber members.

The rigid bearing portion 2 securely supports the bayonet collar 1 to avoid an eccentricity of the bayonet collar 1 to the housing. The elastic bearing portion 3 is arranged apart from the rigid bearing portion 2 and supports the bayonet collar 1. The elastic bearing portion 3 presses the inner peripheral surface of the bayonet collar 1 and supplies the predetermined friction torque to the bayonet collar 1 when operated to be rotated.

The elastic bearing portion 3 is provided with a predetermined elasticity. Therefore, the elastic bearing portion 3 can effectively absorb the size differences between the bayonet collar 1 and cylinder portion 4 because of its elasticity. The elastic bearing portion 3 supplies the stable friction torque to the bayonet collar 1. Consequently, it becomes stable to connect or disconnect the scope portion 15 to or from the main body 14. Furthermore, there is the appropriate friction coefficient between the elastic bearing 3 and the bayonet collar 1, so that this structure depends on the load between the elastic bearing 3 and the bayonet collar 1 less than the conventional method of using the leaf spring. Therefore, there is no need to consider the abrasion of the rigid bearing portion 2, the elastic bearing portion 3 and the bayonet collar 1, respectively.

It is possible to provide an opposed connector (not shown) for the main body 14 for connecting with the connector 100 in order to have an electrical connection or disconnection between the main body 14 and the scope portion 15, at the same time with the connection or disconnection of the connector 100. In other words, when connecting the scope portion 15 with the main body 14 by using the connector 100, it is possible to dispose the opposed connector on the side of the main body 14 which engages with the connector 100, such that the connectors form mutual connections between signal lines, and between shield cases used for shielding electromagnetic radiation.

In this embodiment, a shell 5 is disposed around the terminals 7 as a shield case for shielding electromagnetic radiation and comprises connecting springs 9.

Figure 4:
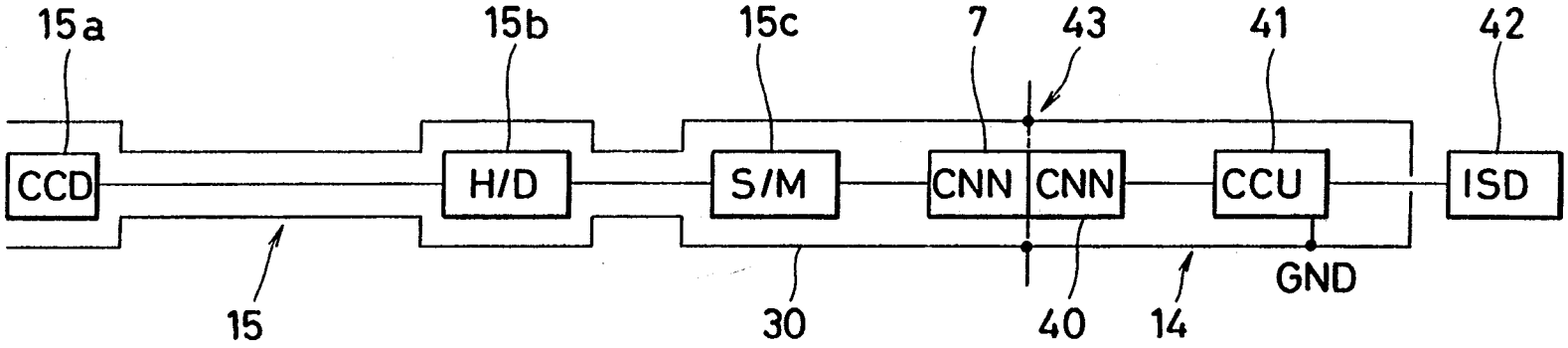
FIG. 4 is a view showing the outline of a shield line which is formed by connecting the scope portion with the main body by using the connector of FIG. 1.

As illustrated in FIG. 4, when the connector on the side of the main body 14 is connected with the connector 100 on the side of the scope portion 15, a shield line is formed to extend from the main body 14 to a top end of the scope portion 15.

In this case, as illustrated in FIG. 4, a head driver 15*b*, a scope memory 15*c*, the terminals 7 are covered with an electromagnetic interference (EMI) shield 30 on the side of the scope portion 15 except CCD 15, and main body side terminals 40, a camera control unit 41 are covered with the EMI shield 30 on the side of the main body 14. The EMI shield 30 is earthed to the camera control unit 41. The camera control unit 41 is connected with an isolation trance 42 disposed outside the EMI shield 30. The numeral 43 designates the shield connecting point.

The camera control unit 41 is supplied with an electric power from the isolation trance 42 and produces a vertical synchronizing signal for driving a CCD 15*a* and a control signal used for a horizontal synchronizing to be sent to the head driver 15*b*. The head driver 15*b* receives a control signal from the camera control unit 41 and produces the vertical synchronizing signal to move the CCD 15*a*. The scope memory 15*c* stores characteristic informations of the scope, for instance, a scope ID, a color characteristic, a mask configuration and so forth.

The contact springs 9 compose the shield connecting point 43. A plurality of the connecting point springs 9 are arranged on the inner surface of the shell 5 and have predetermined spaces between one another. The contact springs 9 are fixed and electrically connected to the inner surface of the shell 5.

Figure 5:
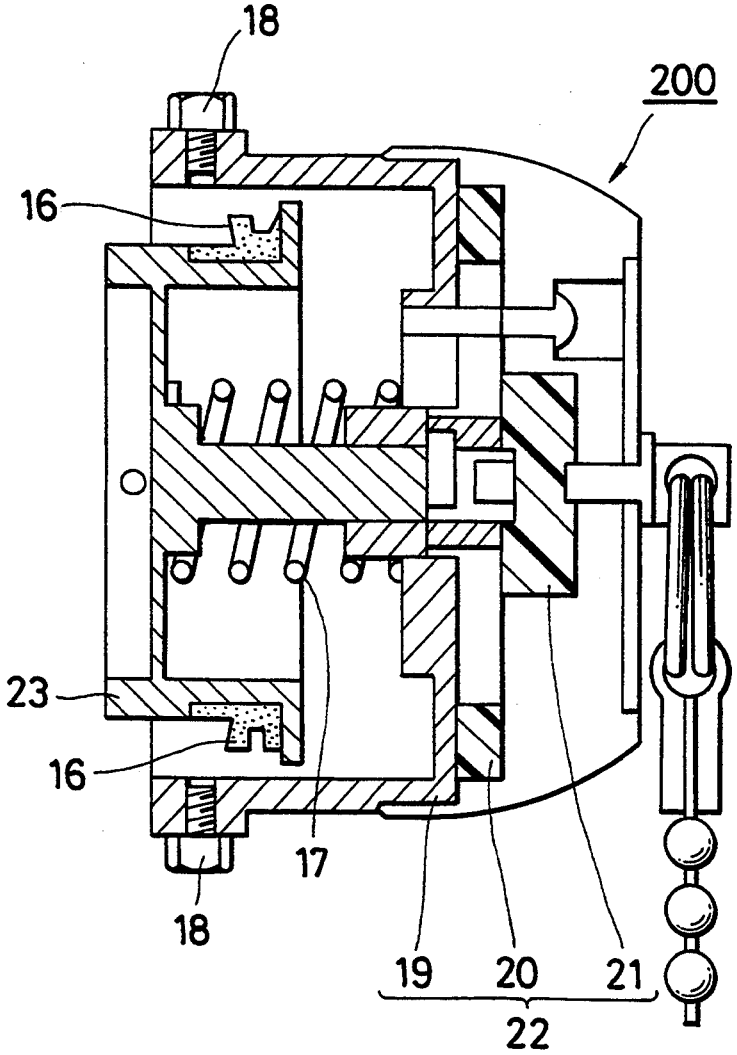
FIG. 5 is a side view of a water-proof cap for being mounted to the connector of FIG. 1.

FIG. 5 is a side view of a water-proof cap 200 mounted on the connector 100 of FIG. 1.

Figure 6:
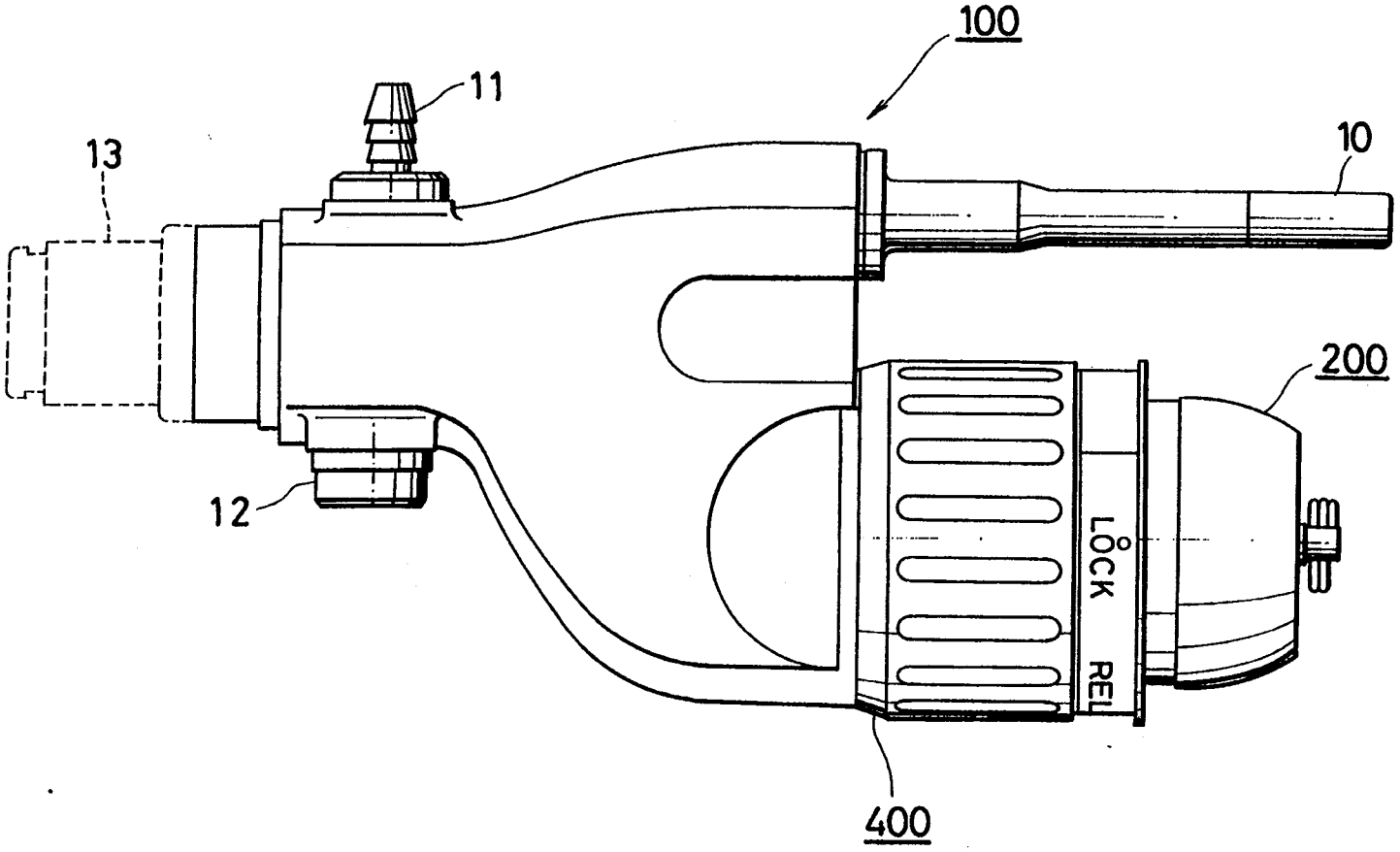
FIG. 6 is a side view showing the connector of FIG. 1 connected with the water-proof cap.

As illustrated in FIG. 6, the water-proof cap 200 interfaces with the connector 100 and is capable of connecting with the main body 400.

That is, the water-proof cap 200 comprises a packing 16 which comes into close contact to the connector end (the end of the shell 5) of the housing and which is capable of cutting off and releasing the inner space of the housing. The housing is composed of the cylinder portion 4, the shell 5 and the insulation material 8. The waterproof cap 200 also comprises a spring 17 which enables the packing 16 to cut off and release by the variation of pressure forces energized by the cam mechanism of the rotating handle 1. The water-proof cap 200 further comprises a pair of guide pins 18 which engage each other with the cam of the bayonet collar 1. The water-proof cap 200 further yet comprises an armoring member 22 which is composed of members 19, 20, 21, the cylinder member 23 supporting the packing 16 and the spring 17, and other members.

Figure 7:
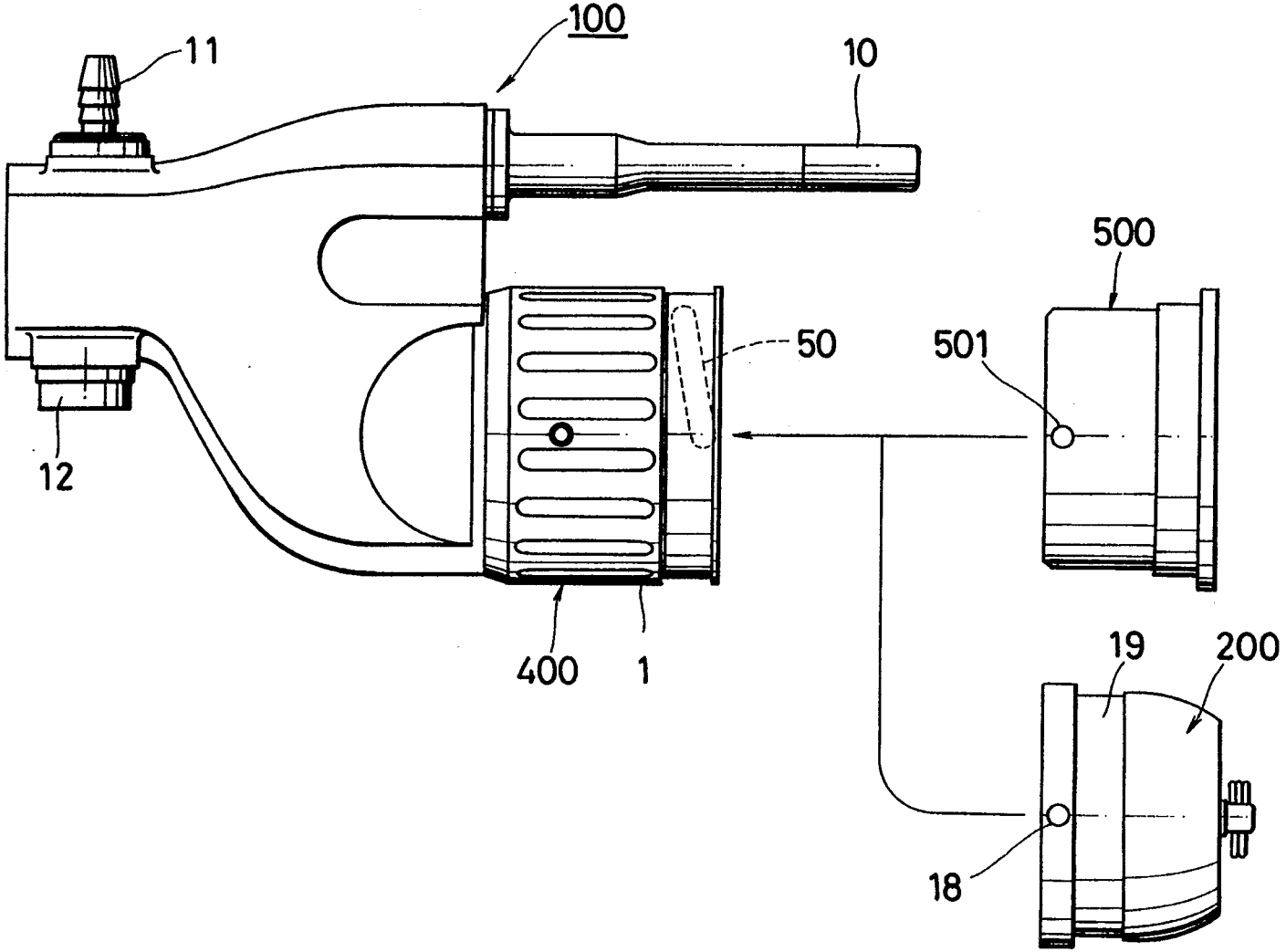
FIG. 7 is a side view showing the cam mechanism provided on the connector of FIG. 1.

FIG. 7 shows an example of the cam mechanism. On the inner surface of the bayonet collar 1, a pair of guide grooves 50 are formed for engaging with the guide pins 18, respectively. The guide grooves 50 are inclined in an axial direction with a predetermined angle and extend, for example, about one fourth of the inner periphery of the bayonet collar 1. Only one of the guide grooves 50 is shown in FIG. 7, the other guide groove 50 not shown in FIG. 7 is formed on the opposed surface of the inner periphery of the bayonet collar 1.

When the guide grooves 50 of the bayonet collar 1 is engaged the guide pins 18 on the water-proof cap 200 and the bayonet collar 1 is rotated, the guide pins 18 slide along the guide grooves 50. With a thrust forth produced by the operation mentioned above, the water-proof cap 200 and the main body 400 come into close contact each other. Consequently, the spring 17 presses the packing 16 against the end of the shell 5 to bring the packing 16 into close contact with the shell 5 each other.

Accordingly, it is accomplished by one rotating operation of the bayonet collar 1 to isolate an inner space of the housing from the outside. The cam process accompanied with the rotating operation is substantially shorter than the conventional screwing process. Therefore, it is possible to connect or disconnect the water-proof cap 200 to or from the main body 400 with an easier operation in a shorter time.

Referring to FIG.7, the reference numeral 500 designates the connector on the side of the main body 400, and 501 designates the guide pin. When the guide pin 501 engages the guide grooves 50 to rotate the bayonet collar 1, the connector 500 connects with the main body 400. In this case, it is possible to acquire the same operation and effect of water-proof cap mentioned above.

Furthermore, though the housing in the above embodiment is constructed with the cylinder portion 4, the shell 5, and the insulating material 8, the housing may be formed integrally with the same material.

What is claimed is:

1. A connector for use in an electric endoscope having a main body and a scope portion, said connector for connecting the main body with the scope portion, said connector comprising:

a housing;

a plurality of terminals held in said housing;

a first bearing portion made of a rigid material and disposed on said housing;

a second bearing portion made of an elastic material and disposed on said housing apart from said first bearing portion; and an operating handle with a cylindrical configuration rotatably supported by said first and second bearing portions, said operating handle having a cam mechanism which is operated with the rotation of said operating handle;

wherein said second bearing portion is pressed and modified between said operating handle and said housing to produce a restitutive force so as to produce a predetermined friction torque surface friction when rotating said operating handle.

2. A connector according to claim 1, wherein said second bearing portion is secured to said housing, and presses an inner peripheral surface of said operating handle to produce a predetermined friction torque when rotating said operating handle.

3. A connector according to claim 2, wherein said second bearing portion comprises a curved portion and a straight line portion, an outer peripheral surface of said curved portion coming into contact with and pressing an inner peripheral surface of said operating handle and said straight line portion being secured to said housing.

4. A connector according to claim 1, wherein said second bearing portion is secured to said operating handle, and presses an outer peripheral surface of said housing to produce a predetermined friction torque when rotating said operating handle.

5. A connector according to claim 4, wherein said second bearing portion comprises a curved portion and a straight line portion, an outer peripheral surface of said curved portion coming into contact with and pressing an outer peripheral surface of said housing and said straight line portion being secured to said operating handle.

6. A connector according to claim 1, wherein said second bearing portion is made of a resin or a rubber of fluorine or polytetrafluoroethylene series.

7. A connector according to claim 1, wherein said cam mechanism includes a groove formed on said inner surface of said operating handle in an inclined manner in an axial direction, said groove being engaged by a first protrusion on said main body, and said first protrusion sliding along said groove by rotating said operating handle to bring said housing into close contact with said main body.

8. A connector according to claim 7, further comprising a water-proof cap having a second protrusion which engages with said groove, said second protrusion sliding along said groove by rotating said operating handle to bring said water-proof cap close contact with said housing.

9. A connector according to claim 8, wherein said water-proof cap includes a sealing member coming into close contact with said housing to seal it, a holding member holding said seal member, and energizing means for energizing said holding member toward said housing.

10. A connector according to claim 9, wherein said energizing means includes a spring.

11. A connector according to claim 1, further comprising a shield case connected to a first shield portion on a side of said main body and a second shield portion on a side of said scope portion through an electric contact to form a shield line from an inside of said main body to said scope portion.

* * * * *